US005897473A

United States Patent [19]

Koenig

[11] Patent Number: 5,897,473

[45] Date of Patent: Apr. 27, 1999

[54] EXERCISE APPARATUS FOR LOWER EXTREMITIES

[75] Inventor: Larry Koenig, Williamsburg, Iowa

[73] Assignee: Jam'n Fitness Corp., Williamsburg, Iowa

[21] Appl. No.: 09/105,288

[22] Filed: Jun. 26, 1998

[51] Int. Cl.[6] ..... A63B 21/06; A63B 23/04

[52] U.S. Cl. ..... 482/97; 482/137

[58] Field of Search ..... 482/97, 100, 137, 482/138

[56] References Cited

U.S. PATENT DOCUMENTS 2,855,199 11/1958 Noland et al. .
4,509,746 4/1985 Mask ..... 482/97
5,683,334 11/1997 Webber .

*Primary Examiner*—John Mulcahy
*Attorney, Agent, or Firm*—Allan L. Harms

[57] ABSTRACT

Exercise apparatus for building strength in the lower extremities while reducing the risk of injury to knee joints. A bench provides a surface on which a user may lie in a prone position. A pivot support member stands beside the bench. A weight-bearing lever is pivotable upon the pivot support member at a horizontal pivot located alongside the bench for the user. A second pivotable lever which has a cushioned leg bar mounted to it is pivotable about a second pivot point on the pivot support member. An arm depends below and perpendicularly to the second pivotable lever. A roller bearing extends from the arm and is received by a bearing race fixed to the underside of the weight-bearing lever. As a user lying prone on the bench moves the leg bar upward by flexion of the leg muscles below the knee, the roller urges the weight-bearing lever upward. The Rolling Fulcrum™ operation of the apparatus causes the pivot support of the weight-bearing lever to move away from the pivot point thereby reducing the moment of the weight on the weight-bearing arm as the user's legs raise the leg bar upward. The bearing race limits the travel of the roller bearing along the weight-bearing lever, thereby limiting the arc over which the weight may travel so that the weight does not pass over the pivot point.

20 Claims, 4 Drawing Sheets

EXERCISE APPARATUS FOR LOWER EXTREMITIES

BACKGROUND OF THE INVENTION

In the realm of body exercise and strength training, there is a need to strengthen the muscles of the thigh which are used to flex the leg at the knee. In order to build strength in the user's leg flexion muscles, it is essential to increase the resistive load on the muscles as the user's strength level increases. It is also desirable to reduce the risk of injury and to increase the range of motion as the exercise is performed.

Various exercise devices have been devised to exercise the thigh muscles as the legs are flexed at the knee. These devices function by allowing the user, while lying prone, to engage the posterior lower leg underneath a weighted bar and then to force the bar in an upward arc as the leg is flexed. Some of these devices cause the effective resistance to maximize as the knee reaches full flexion when the knee is most vulnerable to injury. Other leg flexion exercisers work on similar principles but with complicated lever arrangements without satisfactorily reducing the resistance on the leg as the leg is flexed at the knee.

SUMMARY OF THE INVENTION

It is an object of the present invention to provide an exercise apparatus which permits a user to build leg strength while reducing the risk of injury to knee structures. This is accomplished by a load weight decrease as the knee joint comes into full extension. This changing resistance during the execution of this exercise is accomplished by the use of Negative Variable Resistance™ loading. Negative Variable Resistance™ loading means that as the concentric contraction of the hamstring muscles of the posterior thigh is being performed, the effective load is decreasing. This principle encourages full range of motion without generating excessive momentum and joint shear to the knees.

The invention includes a generally rectangular frame upon which is mounted an angled horizontal platform to accept the user in prone position. A pivot supporting post is disposed slightly forward of and to the side of the user. A weight-bearing lever is pivotally mounted to the top of the post and extends away from the user. At rest, the weight-bearing lever rests on a support post standing upright from the frame and spaced away from the user. A bearing race is fixed longitudinally along the lower side of the weight-bearing lever near its pivot mount on the pivot supporting post. A weight-mounting rod is fixed to the weight-bearing lever a distance from the pivot mount of the weight-bearing lever. The weight-mounting rod is essentially horizontal and perpendicular to the weight-bearing lever and sized to receive typical circular barbell weight plates.

An activation lever is suspended from the pivot support post but its pivot on the pivot support post is offset from the pivot of the weight support lever such that the pivot of the activation lever is spaced laterally further from the user than the pivot of the weight-bearing lever. The activation arm includes a first leg which is horizontal when the device is at rest. A second leg is perpendicularly mounted to the first leg at its pivot. The second leg is provided with a roller bearing which extends perpendicularly from the second leg and is received in the bearing race mounted to the weight-bearing lever. A transverse leg engagement bar extends perpendicularly from the first leg of the activation lever such that when the apparatus is at rest, the leg engagement bar is disposed slightly above and away from the horizontal platform so that the back of the user's lower legs or ankles can be positioned underneath the leg engagement bar. As the user flexes the legs at the knee, the activation arm pivots upward and toward the user and in doing so, the roller in the bearing race causes the weight-bearing lever to rotate upward about its pivot mount.

The effective length of the first leg of the activation lever is adjustable through use of a telescoping inner box tube selectively positioned by pin means. As the weight-bearing lever is forced upward by the roller attached to the second leg of the activation lever, the effective fulcrum of the weight-bearing lever moves away from the user thereby reducing the moment arm of the weight-bearing lever applied to the user's legs as the leg is flexed at the knee. This reduces stress on the user's knee components and increases the range of motion. This is the benefit of Negative Variable Resistance™. The invention is able to accomplish reduction in joint stress by using dual offset pivoting levers and a Rolling Fulcrum™ that diverges away from the pivots. This divergent Rolling Fulcrum™ pushes up and toward the weight load, thereby varying the load. The Rolling Fulcrum™ is a critical concept to these machines and how they effect variable resistance and smooth, dependable usage.

It is also an object of the invention to provide leg flexion exercise apparatus which is simple in construction and maintenance. Another objective of the invention is to provide a leg exercise apparatus which permits use of existing barbell weight plates for loading. Another objective of the invention is to provide a leg apparatus which facilitates addition and removal of weights at a relatively low height. It is a further objective of the invention to provide leg-strengthening apparatus which is safe and stable in use.

These and other objectives will be understood from a review of the detailed description below.

DESCRIPTION OF THE DRAWING FIGURES

DETAILED DESCRIPTION OF THE INVENTION

Figure 1:
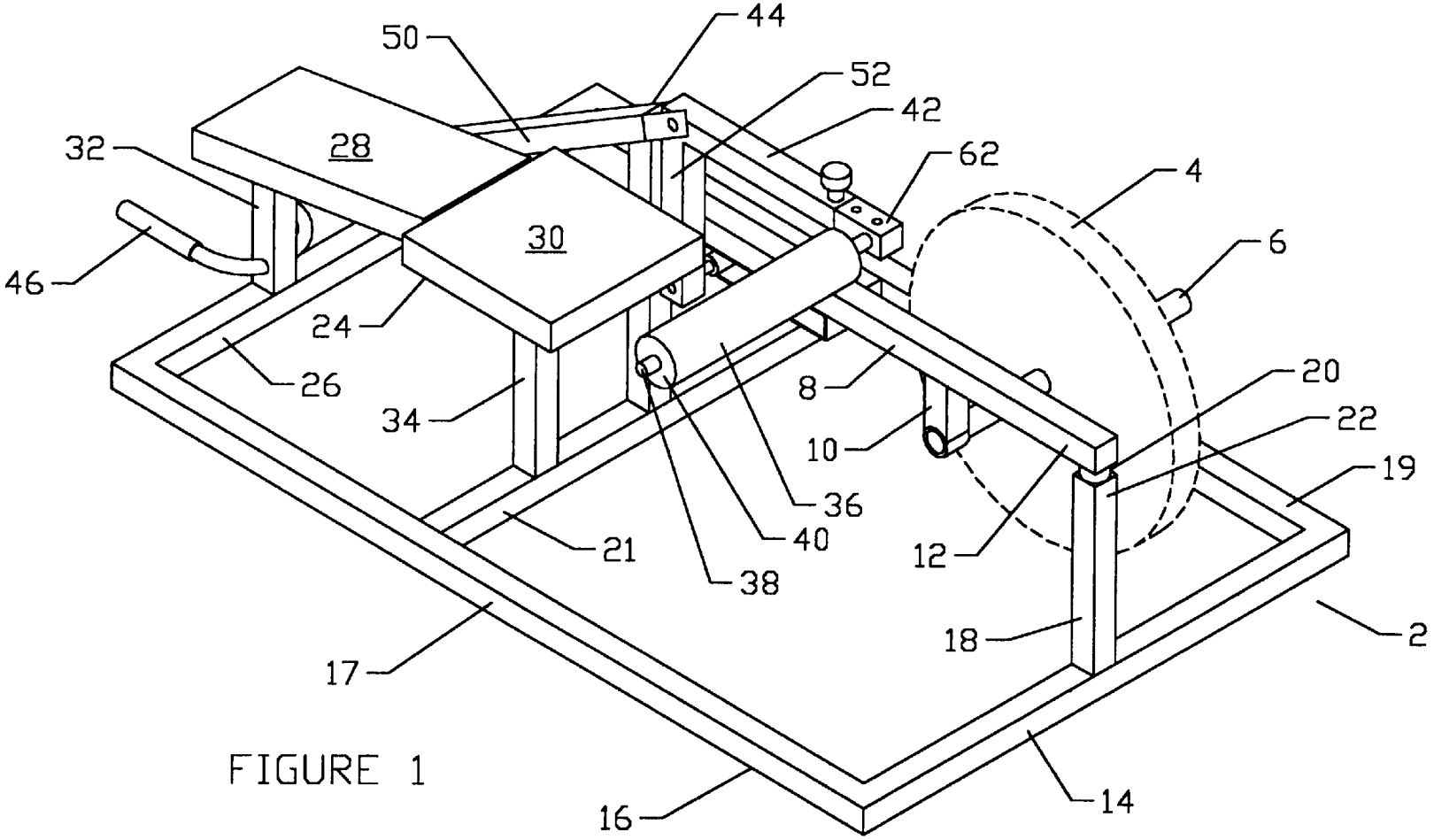
FIG. 1 is a right front perspective of the preferred embodiment of the leg curl exercise apparatus showing in phantom a weight plate mounted to the apparatus.

Referring to the drawings, FIG. 1 illustrates the exercise apparatus 2 shown at rest with an Olympic weight plate 4 shown in phantom mounted to the weight mounting rod 6. It is intended that phantom weight plate 4 represent varying sizes of weights as well as represent multiple weight plates which may be slid onto weight mounting rod 6. Weight mounting rod 6 is fixed along weight bearing lever 8 by spacer 10 such that weight mounting rod 6 is disposed below weight bearing lever 8 and off center therefrom. In the preferred embodiment, weight mounting rod 6 is an elongate rod of circular cross section sized to be received in the central holes of standard circular Olympic disks such as weight plate 4. Other mounting structures could be equally useful in allowing for selective loading of weight bearing lever 8.

Spacer 10 fixes weight mounting rod 6 to weight bearing lever 8 at a distance from the free end 12 of weight bearing lever 8 in order to conveniently locate weight plate 4 within the footprint of base 16. The design of the preferred embodiment exercise apparatus is intended to provide for a footprint of base 16 to be standardized with the footprints of the bases of other equipment manufactured by Jam'n Fitness Corp. of Williamsburg, Iowa. 311 Upstanding from foot end 14 of base 16 is rest support member 18 which supports free end 12 of weight bearing lever 8 when the exercise apparatus 2 is at rest. A resilient bumper 20 is disposed upon the upper end 22 of rest support member 18 to dampen the impact of free end 12 upon upper end 22 of rest support member 18 when the exercise apparatus 2 comes to rest.

Figure 2:
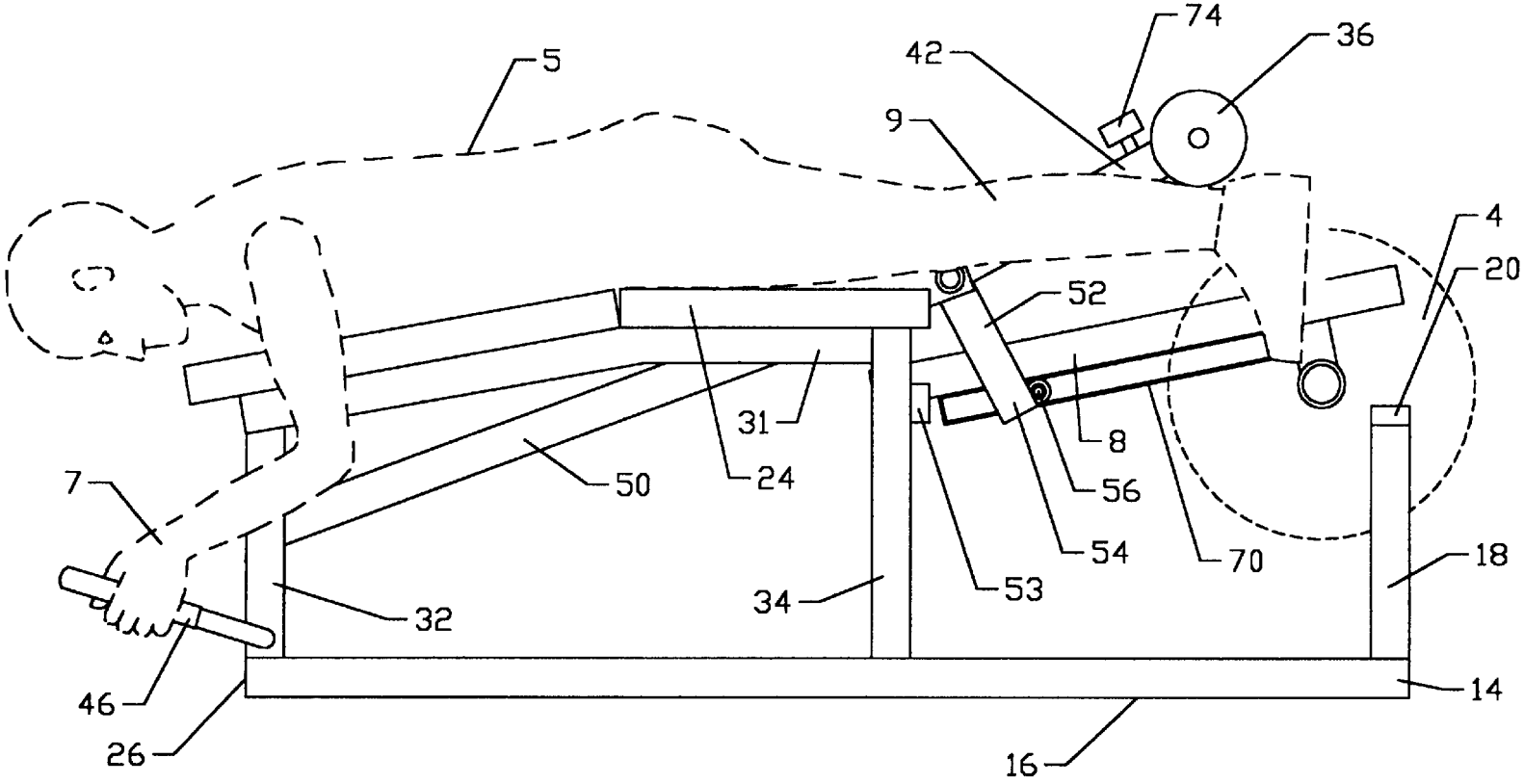
FIG. 2 is a front elevation of the preferred embodiment of the invention with a user shown in phantom lying on the apparatus in position to exercise the user's legs.
Figure 3:
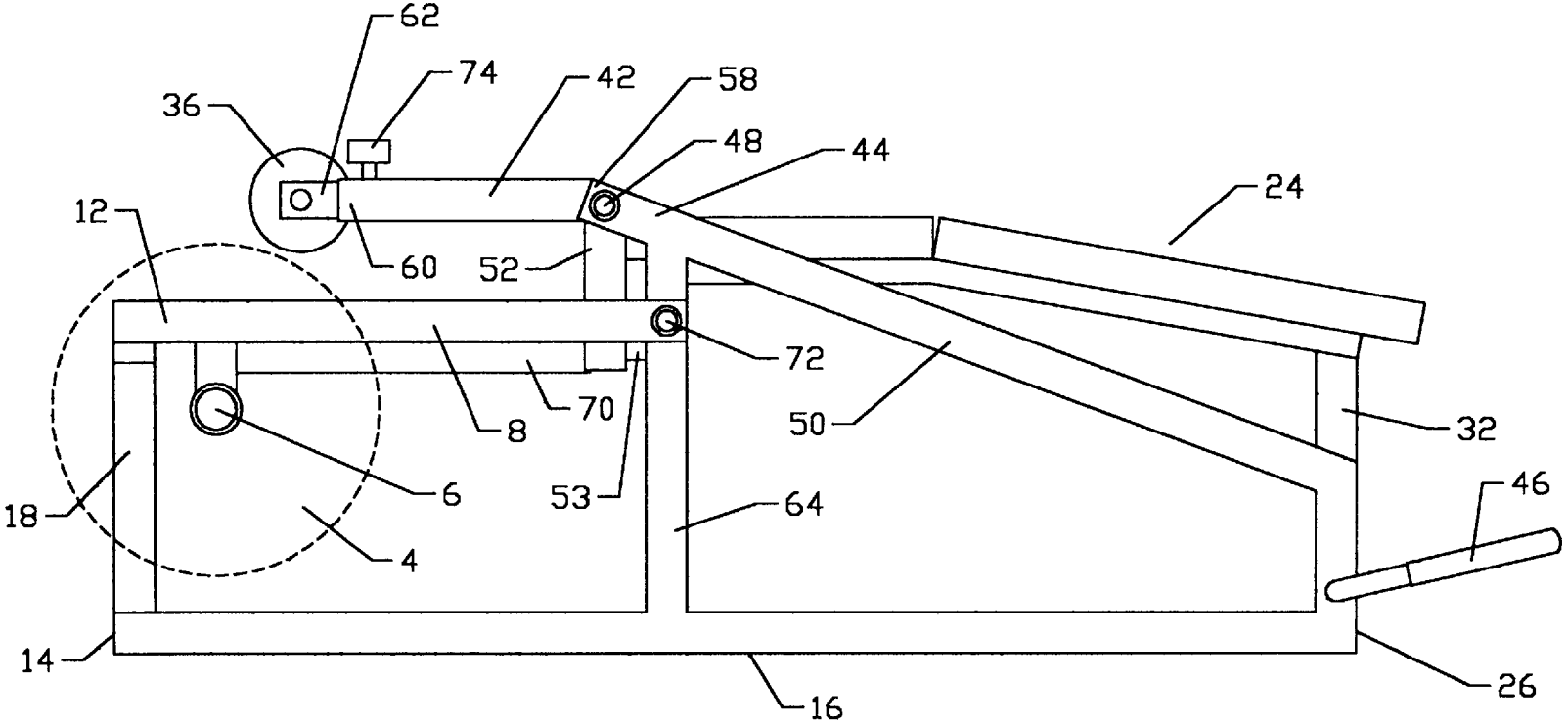
FIG. 3 is a rear plan view of the preferred embodiment of the invention.
Figure 4:
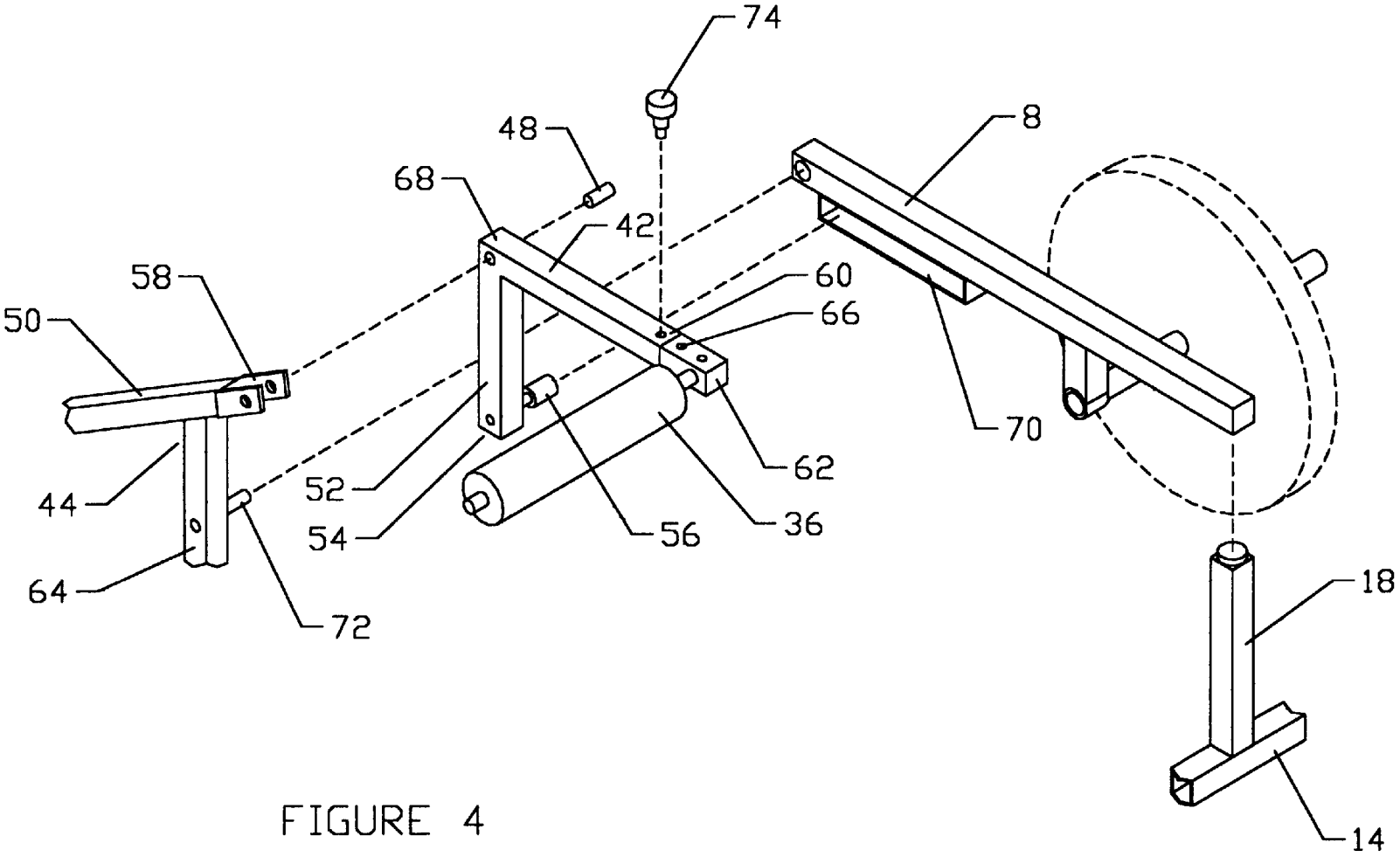
FIG. 4 is a partly exploded perspective view of the lever mechanisms of the invention with a weight plate shown in phantom.

Referring to FIG. 2, it is seen that bench 24 is mounted above base 16 and provides a surface on which a user 5 may lie in a prone position with the user's hands 7 grasping handles 46 and with the user's legs 9 positioned below leg engagement bar 36. Bench 24 includes torso support cushion 28 and hip support cushion 30 supported on rail 31. In the preferred embodiment, torso support cushion 28 is slightly inclined from head end 26 of base 16 toward hip support cushion 30. Bench 24 is supported above base 16 by first leg 32 and second leg 34 at a convenient height for a user to safely mount bench 24 and assume a prone position thereon.

Referring now to FIGS. 1–4, it is seen that in the preferred embodiment of the invention, base 16 is a rectangular frame having opposing longer sides 17 and 19 interconnecting foot end 14 and head end 26. A transverse beam 21 is fixed between longer sides 17 and 19 spaced apart from and generally parallel to head end 26 and foot end 14.

A pivot support member 44 comprises an inclining brace 50 supported by a vertical post 64 mounted upon transverse beam 21. Brace 50 includes extending spaced apart ears 58 which are co-linear with brace 50 and which receive pivot end 68 of activation lever 42, activation lever 42 being hingedly fixed to ears 58 by pivot pin 48. Activation lever 42 is provided with leg engagement bar 36 mounted to its free end 60 such that leg engagement bar 36 is disposed essentially horizontally above base 16. When exercise apparatus 2 is at rest, activation lever 42 is disposed at generally the same height as hip support cushion 30. Activation lever 42 may be extensible by use of a telescoping inner bar 62 selectively locked in place by the interaction of plunger 64 and holes 66. The adjustability of activation lever 42 permits the invention to be used by users of a variety of heights.

A trailing arm 52 depends from activation lever 42 at a perpendicular below activation lever 42. The free end 54 of trailing arm 52 is provided with a roller bearing 56 depending horizontally therefrom in an outboard direction. Roller bearing 56 is received within bearing race 70 which is elongate and mounted longitudinally to the underside of weight bearing lever 8. An elastomeric damper 53 is fixed to the side of vertical post to cushion the return of trailing arm 52 to its rest position.

Weight bearing lever 8 is pivotably mounted to pivot support member 44 at its pivot pin 48 by means of stub axle 72 which extends in an outboard direction from vertical post 64 of pivot support member 44. It is to be noted that the pivot axis of weight bearing arm 8 is spaced below and outboard from the pivot axis of activation lever 42, as well as horizontally nearer to head end 26. Due to this structural arrangement, as activation lever 42 is arcuately raised by the user's application of force to the leg engagement bar, roller bearing 56 exerts upward force to the underside of weight bearing lever 8 as it rolls along bearing race 70. This Rolling Fulcrum™ operation of the exercise apparatus 2 serves to increase the moment of the user's legs 9 relative to the moment of the weight 4 as activation lever 42 is rotated upwardly, thereby reducing the force needed as the weight 4 rises.

The length of bearing race 70 is selected to limit the travel of roller bearing 56 and thereby to limit the height to which leg engagement bar 36 may be raised as it pivots about pivot pin 48. When leg engagement bar 36 is lowered and weight bearing lever 8 rotates about stub axle 72 to a horizontal position, it is prevented from further downward movement as free end 12 thereof abuts bumper 20 atop rest support member 18.

Having described the invention, I claim:

1. Leg exercise apparatus comprising a base having a substantially horizontal bench supported over the base, a first support member mounted to said base, a weight-bearing lever pivotally mounted to said first support member at a pivot mount disposed above said base, the weight-bearing lever having means to selectively affix weights thereto along the length thereof, an elongate arm suspended from said first support member by a hinge, said hinge disposed above said base, said elongate arm having means to touchingly engage the legs of a user lying prone upon said bench to allow the user to use the user's legs to urge said elongate arm upward, said elongate arm having a roller mounted thereto, said weight-bearing lever having a bearing race longitudinally mounted thereto, said roller received in said race and moveable therealong, said roller urging said weight-bearing lever upward as said elongate arm is urged upward.

2. The leg exercise apparatus of claim 1 wherein said base has a head end and a foot end, a second support member is mounted to said foot end of said base, said second support member generally vertically disposed at the height of said pivot mount of said weight-bearing lever, said weight-bearing lever resting on said second support member when said elongate arm is at rest.

3. The leg exercise apparatus of claim 1 wherein said first support member comprises an upstanding post mounted to said base, said pivot mount of said weight-bearing lever disposed alongside said bench, said hinge of said elongate arm disposed above said pivot mount of said weight-bearing lever, said hinge of said elongate arm laterally spaced closer to said foot end than said pivot mount of said weight-bearing lever.

4. The leg exercise apparatus of claim 1 wherein said elongate arm has a pivot end and a free end, said elongate arm having a lever arm depending perpendicularly therefrom along its length, said roller mounted to said lever arm.

5. The leg exercise apparatus of claim 1 wherein said weight-bearing lever is pivotable within a vertical plane, said elongate arm pivotable within a vertical plane generally parallel to said plane of movement of said weight-bearing lever.

6. The leg exercise apparatus of claim 5 wherein said apparatus has a rest position, said weight-bearing lever disposed generally horizontally when said apparatus is at rest, said elongate arm disposed generally horizontally when said apparatus is at rest.

7. The leg exercise apparatus of claim 6 wherein said plane of movement of said elongate arm is displaced laterally from said plane of movement of said weight-bearing lever.

8. The leg exercise apparatus of claim 1 wherein said base has a head end and a foot end, said first support member has an upper end, an angled extension extends from the upper end of said first support member, said pivot mount fixed to said first support member, said hinge fixed to said angled extension, said angled extension inclining toward said foot end of said base.

9. The leg exercise apparatus of claim 8 wherein said apparatus has a rest position, said weight-bearing lever disposed generally horizontally when said apparatus is at rest, said elongate arm disposed generally horizontally when said apparatus is at rest.

10. The leg exercise apparatus of claim 8 wherein a second support member is mounted to said base laterally displaced from said first support member, said second support member generally vertically disposed at the height of said pivot mount of said weight-bearing lever, said weight-bearing lever resting on said second support member when said elongate arm is at rest.

11. Leg exercise apparatus having a base with a bench on which a user may lie in a prone position comprising the bench having a head end and a knee end and a central longitudinal axis, a support member mounted to said base and extending thereabove, an elongate weight bearing member pivotably mounted to said support member at a first pivot, means to attach weights along the length of said weight bearing member, an elongate lever pivotably mounted to said support member at a second pivot, said elongate lever having an arm depending therefrom along the length thereof, said arm having a bearing member along the length thereof, said weight bearing member having a longitudinal bearing surface therealong, said bearing member of said arm touchingly engaging said bearing surface of said weight bearing member and being moveable therealong, said elongate lever having a leg engagement bar extending laterally therefrom, said elongate lever urging said weight bearing member upward when said leg engagement bar is urged upward.

12. The leg exercise apparatus of claim 11 wherein said second pivot is horizontally displaced from said first pivot.

13. The leg exercise apparatus of claim 11 wherein said bearing member is a roller on an axle, said axle is perpendicularly mounted to said arm.

14. The leg exercise apparatus of claim 11 wherein said means to attach weights to said weight bearing member is a rod transversely mounted to said weight bearing member, said rod sized to be received in the central holes of circular weight plates.

15. The leg exercise apparatus of claim 11 wherein said bearing surface has opposing ends, said opposing ends of said bearing surface limit travel of said bearing member along said bearing surface.

16. The leg exercise apparatus of claim 11 wherein said support member comprises a vertical post disposed alongside said bench, said support member has an angled extension extending therefrom, said first pivot is mounted to said vertical post, said second pivot is mounted to said angled extension.

17. The leg exercise apparatus of claim 11 wherein said elongate lever is selectively longitudinally extendible.

18. The leg exercise apparatus of claim 11 wherein said base has a head end and a foot end, a rest support is disposed on said frame at said foot end, said rest support abuts said elongate weight bearing member when said exercise apparatus is at rest, said elongate weight bearing member is substantially horizontal when said exercise apparatus is at rest.

19. The leg exercise apparatus of claim 11 wherein said weight bearing member has an underside, said bearing surface is on said underside of said weight bearing member.

20. The leg exercise apparatus of claim 19 wherein said bearing surface comprises a bearing race longitudinally mounted to said underside of said weight bearing member, said bearing race has opposing end walls, said bearing member is a roller on an axle, said axle is perpendicularly mounted to said arm, said roller rolls along said bearing race as said leg engagement bar is raised.

* * * * *